US009835009B2

(12) United States Patent
Hess et al.

(10) Patent No.: US 9,835,009 B2
(45) Date of Patent: Dec. 5, 2017

(54) METHOD AND APPARATUS FOR MANAGING ANNULAR FLUID EXPANSION AND PRESSURE WITHIN A WELLBORE

(71) Applicant: Halliburton Energy Services, Inc., Houston, TX (US)

(72) Inventors: Joe E. Hess, Richmond, TX (US); Andy J. Cuthbert, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/653,794

(22) PCT Filed: Mar. 25, 2014

(86) PCT No.: PCT/US2014/031756
§ 371 (c)(1),
(2) Date: Jun. 18, 2015

(87) PCT Pub. No.: WO2015/147806
PCT Pub. Date: Oct. 1, 2015

(65) Prior Publication Data
US 2017/0002624 A1 Jan. 5, 2017

(51) Int. Cl.

| | |
|---|---|
| ***E21B 21/08*** | (2006.01) |
| ***E21B 33/04*** | (2006.01) |
| ***E21B 33/043*** | (2006.01) |
| ***E21B 33/047*** | (2006.01) |
| ***E21B 34/02*** | (2006.01) |
| ***E21B 21/10*** | (2006.01) |

(Continued)

(52) U.S. Cl.
CPC ..... *E21B 34/02* (2013.01); *E21B 21/08* (2013.01); *E21B 21/106* (2013.01); *E21B 21/12* (2013.01); *E21B 33/04* (2013.01); *E21B 33/047* (2013.01); *E21B 33/043* (2013.01); *E21B 47/06* (2013.01); *E21B 47/065* (2013.01)

(58) Field of Classification Search
CPC ..... E21B 21/08; E21B 21/106; E21B 21/12; E21B 33/04; E21B 33/043; E21B 33/047; E21B 34/02; E21B 34/04; E21B 47/06; E21B 47/065
See application file for complete search history.

(56) References Cited

U.S. PATENT DOCUMENTS 4,223,738 A * 9/1980 Boutet ..... E21B 33/043 166/368
5,092,401 A * 3/1992 Heynen ..... E21B 33/04 166/208

(Continued)

OTHER PUBLICATIONS

International Search Authority, International Search Report and Written Opinion, dated Dec. 22, 2014, 10 Pages, Korean Intellectual Property Office.

*Primary Examiner* — Matthew R Buck
(74) *Attorney, Agent, or Firm* — Haynes and Boone, LLP

(57) ABSTRACT

A well, well head, drilling and completion system, and method for relieving pressure buildup between concentric casing annuli. The well head includes casing hangers and a tubing hanger that may include annular pressure relief conduits formed therein, which selectively vent casing annuli to the interior of the production tubing. Annular pressure relief valves are located within the annular pressure relief conduits, which may open and/or shut based on pressure, temperature, or elapsed time.

28 Claims, 8 Drawing Sheets

(51) Int. Cl.
*E21B 21/12* (2006.01)
*E21B 47/06* (2012.01)

(56) References Cited

U.S. PATENT DOCUMENTS

| | | | | |
|---|---|---|---|---|
| 5,259,451 | A | 11/1993 | Kent et al. | |
| 7,073,591 | B2 * | 7/2006 | Massie | E21B 33/076 166/348 |
| 8,061,428 | B2 * | 11/2011 | Fenton | E21B 33/04 166/339 |
| 8,316,946 | B2 * | 11/2012 | June | E21B 33/043 166/319 |
| 8,322,441 | B2 * | 12/2012 | Fenton | E21B 17/1007 166/339 |
| 8,631,873 | B2 * | 1/2014 | Sneed | E21B 23/01 138/177 |
| 9,051,824 | B2 * | 6/2015 | Broussard | E21B 33/04 |
| 9,279,308 | B2 * | 3/2016 | June | E21B 34/04 |
| 2010/0236780 | A1 | 9/2010 | Hermes et al. | |
| 2011/0114333 | A1 * | 5/2011 | Fenton | E21B 34/08 166/373 |
| 2011/0120716 | A1 | 5/2011 | Williams et al. | |
| 2012/0160512 | A1 | 6/2012 | Given et al. | |

* cited by examiner

METHOD AND APPARATUS FOR MANAGING ANNULAR FLUID EXPANSION AND PRESSURE WITHIN A WELLBORE

The present application is a U.S. National Stage patent application of International Patent Application No. PCT/US2014/031756, filed on 25 Mar. 2014, the benefit of which is claimed and the disclosure of which is incorporated herein by reference in its entirety.

TECHNICAL FIELD

The present disclosure relates generally to oilfield equipment, and in particular to wells, drilling and completion systems, and techniques for completion of wells and production of hydrocarbons from drilled wellbores in the earth. More particularly still, the present disclosure relates to an improvement in systems and methods for managing annular pressure buildup and fluid expansion between successive casing strings within a wellbore.

BACKGROUND

Systems for producing hydrocarbons from wellbores typically employ a well head, which includes a well head housing, connected atop surface casing extending into the earth from the top of the wellbore and cemented into place within the wellbore. During drilling and completion operations, a blowout preventer may be included atop the well head housing.

Generally, as a wellbore is drilled, successively smaller diameter casing strings are concentrically installed in the well bore at deeper depths, suspended from casing hangers landed, seated, and locked within the well head housing. The casing strings isolate the wellbore from the surrounding formation. The area between any two adjacent casings defines a casing annulus. Similarly, production tubing is typically concentrically installed within the inner casing, suspended from a tubing hanger landed and seated within the well head housing. The production tubing provides a conduit for producing the hydrocarbons entrained within the formation. An inner casing annulus is defined between the inner casing and the production tubing. Moving outward from the production tubing to the outermost casing, these various annuli are conventionally identified alphabetically as the A-annulus, B-annulus, C-annulus, etc.

Typically, each casing hanger is sealed within the well head housing by a mechanical seal assembly. Accordingly, the upper end of each casing is sealed from the adjacent casing. Likewise, cement is typically deposited about the lower end of each casing string to form a casing shoe, thereby sealing the annulus at the lower end of a casing string, with the result being that any fluid located within a casing annulus may become trapped. If fluid constrained within an annulus becomes pressurized, such as from a leak or thermal expansion, a pressure differential may overstress and/or rupture a casing or tubing wall. The phenomenon of trapped annulus pressure or annular pressure buildup is traditionally addressed by overdesigning casing strings and production tubing, with a concomitant cost penalty.

BRIEF DESCRIPTION OF THE DRAWINGS

Embodiments are described in detail hereinafter with reference to the accompanying figures, in which.

DETAILED DESCRIPTION

Figure 1:
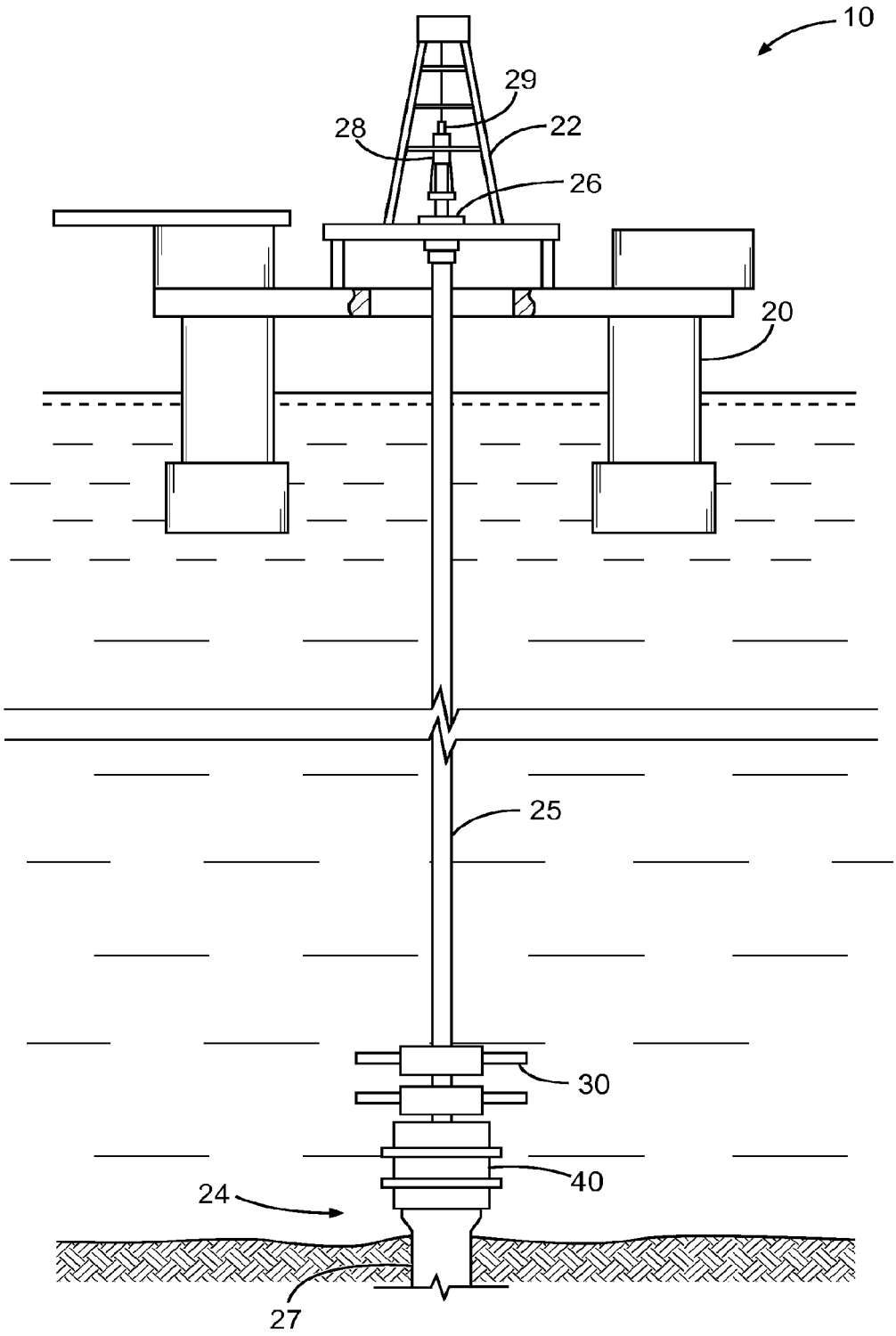
FIG. 1 is an elevation view in partial cross section of a well and an offshore drilling system according to an embodiment, showing a subsea well head serviced by an offshore platform via a riser.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 is an elevation view in cross-section of a drilling system 10 according to an embodiment. Drilling system 10 includes a drilling rig 22, which may include a rotary table 26, a top drive unit 28, a hoist 29, and other equipment necessary for drilling a wellbore in the earth. Drilling system 10 may include an offshore platform 20, such as a tension leg platform, spar, semi-submersible, or drill ship. However, drilling system 10 may be a land drilling system or any other drilling system capable of forming a wellbore extending through one or more downhole formations.

Drilling rig 22 may be located generally above a well head 24, which in the case of an offshore location is located at the sea bed and is connected to drilling rig 22 via a riser 25. Riser 25 allows drill pipes, casing, tubing, and other tools or devices to be run into and out of the wellbore 27. Blowout preventers 30 and/or a Christmas tree assembly (not illustrated) may be provided atop well head 24.

Figure 2:
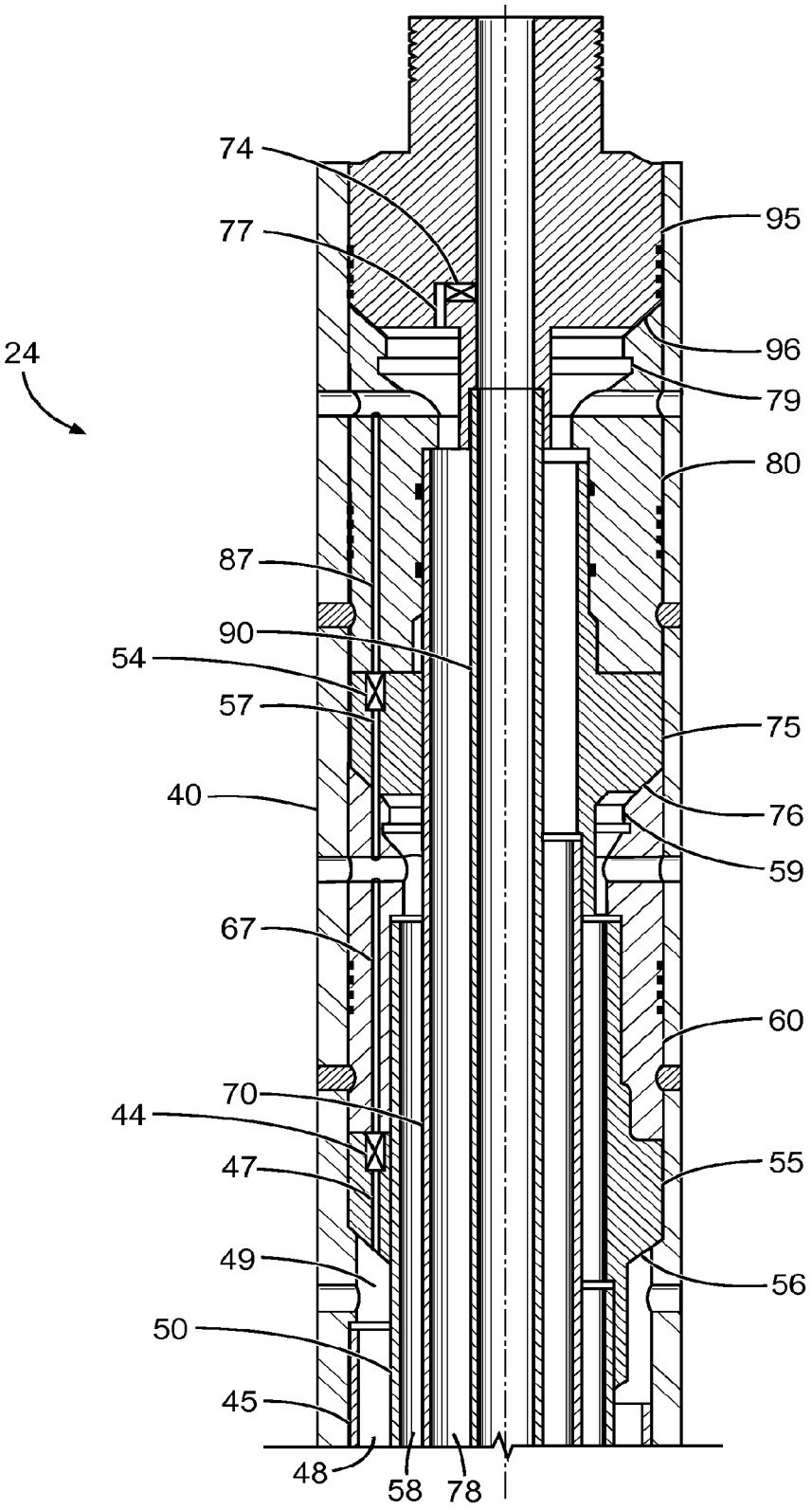
FIG. 2 is an axial cross section of a portion of the well head of FIG. 1, showing three casings and a production tubing in a coaxial arrangement, casing hangers, a tubing hanger, and a pressure relief system according to an embodiment.
Figure 3A:
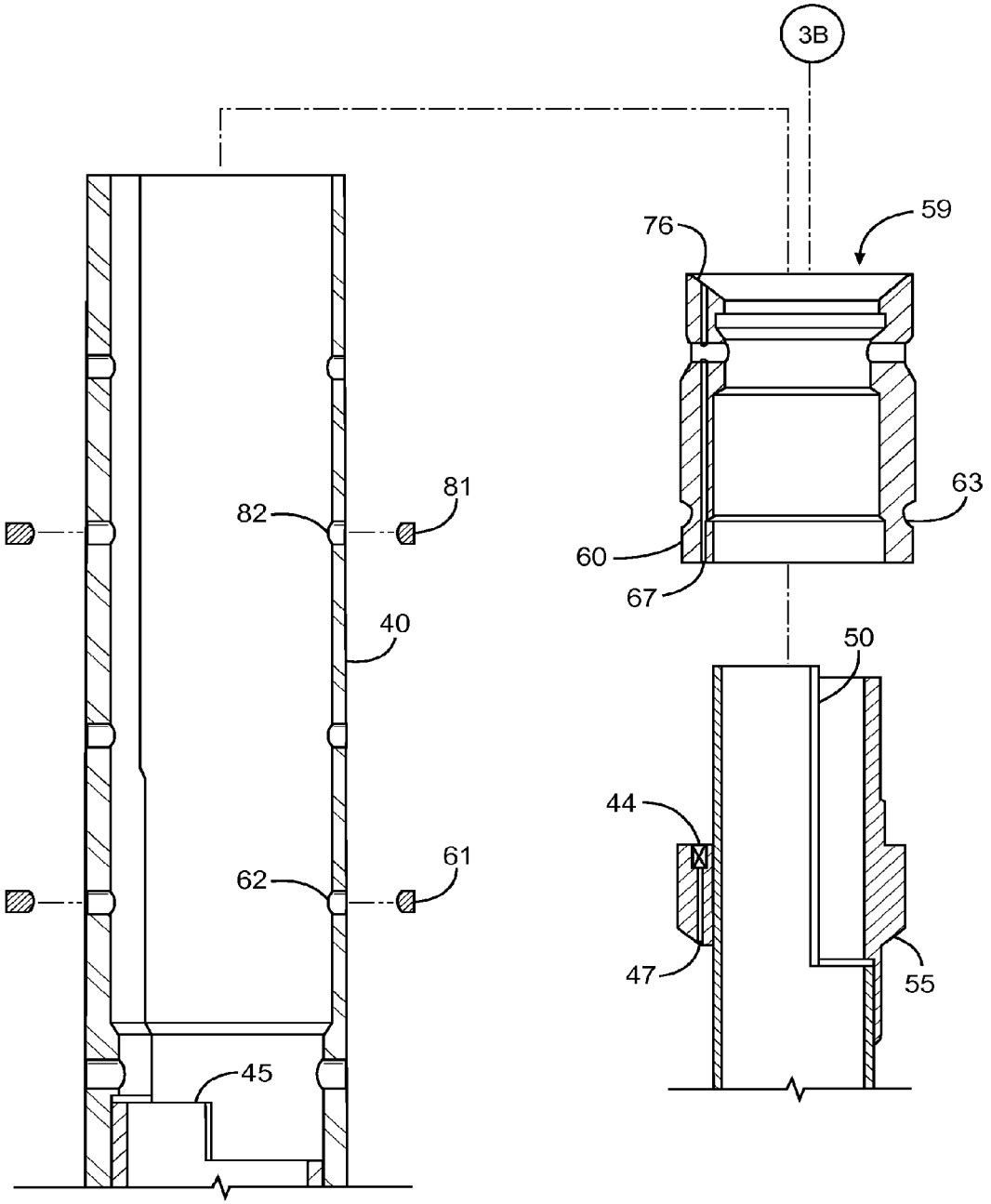
FIGS. 3A and 3B are an exploded diagram of the well head of FIG. 2 in axial cross section.
Figure 3B:
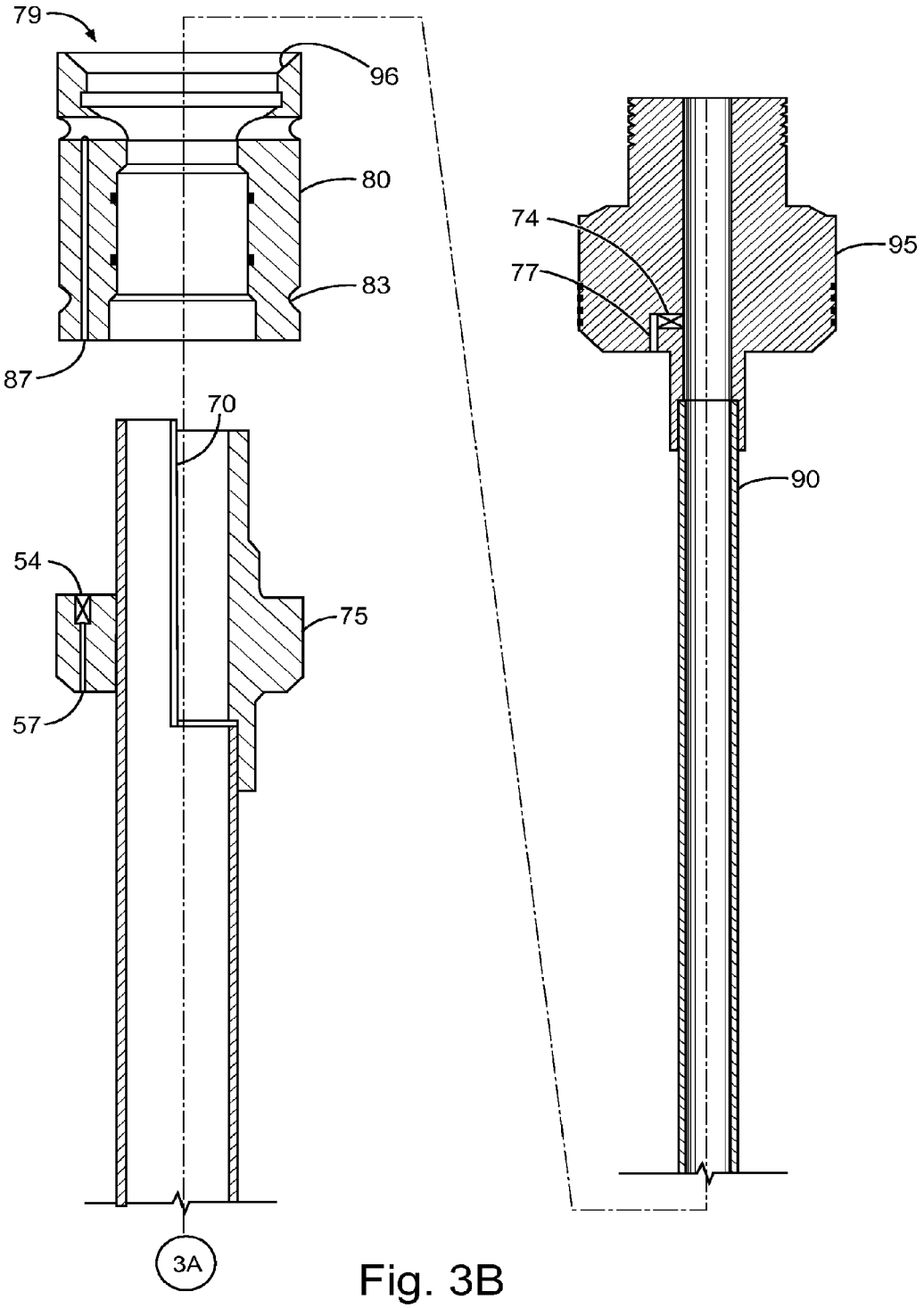

FIG. 2 is an axial cross section of a portion of well head 24 of FIG. 1 according to an embodiment. FIGS. 3A and 3B combined are an exploded view of FIG. 2. Referring to FIGS. 2, 3A and 3B, well head 24 includes a well head housing 40, which may be mounted atop a surface casing (not illustrated) that is run and cemented into an earthen foundation. In some embodiments, the surface casing may be a commercially available 26 inch or 20 inch surface casing, for example. Well head housing 40 may be formed of several discrete commercially available components, including a casing head housing that mounts atop the surface casing, a casing spool that mounts atop the casing head housing, and a tubing spool that mounts atop the casing spool. However, other combinations, including a unitary well head housing, may be used as appropriate. In an embodiment, well head housing may be an American Petroleum Institute (API) standard 13⅝ inch housing.

An outer casing 45 is run and cemented into an upper portion of wellbore 27 (FIG. 1), and the upper end of outer casing 45 is received within well head housing 40. In some embodiments, outer casing 45 may be a 13⅜ inch diameter casing, while in other embodiments; outer casing 45 may have a different diameter.

An intermediate casing 50 is run into outer casing 45. An upper end of intermediate casing 50 is connected to an intermediate casing hanger 55, and intermediate casing hanger 55 is seated on a shoulder 56 within the interior of well head housing 40, thereby suspending intermediate casing 50 within outer casing 45. In some embodiments, intermediate casing 50 may be a 9⅝ inch diameter casing, while in other embodiments, intermediate casing 50 may have a different diameter.

The region between the interior of outer casing 45 and the exterior of intermediate casing 50 defines an outer annulus 48. A lower cavity 49 is defined within the interior of well head housing 40 between the top end of outer casing 45 and the bottom of intermediate casing hanger 55. Lower cavity 49 is in fluid communication with outer annulus 48.

An intermediate annular seal bushing 60 is received within well head housing 40 above intermediate casing hanger 55. Intermediate annular seal bushing 60 includes O-rings or other seals that seal intermediate annular seal bushing 60 between an interior wall of well head housing 40 and an exterior wall of intermediate casing 50, intermediate casing hanger 55, or both, thereby sealing outer annulus 48 and lower cavity 49. In some embodiments, radial locking pins 61 may be set through apertures 62 formed in well head housing 40 and recesses 63 formed in intermediate annular seal bushing 60 to ensure proper rotative alignment and lock intermediate annular seal bushing 60 into place within well head housing 40.

An inner casing 70 is run into intermediate casing 50. An upper end of inner casing 70 is connected to an inner casing hanger 75, and inner casing hanger 75 is seated on a shoulder 76 formed by a top end of intermediate annular seal bushing 60, thereby suspending inner casing 70 within intermediate casing 50. In some embodiments, inner casing 70 may be a 7 inch diameter casing, while in other embodiments, intermediate casing 50 may have a different diameter.

The region between the interior of intermediate casing 50 and the exterior of inner casing 70 defines an intermediate annulus 58. Intermediate annular seal bushing 60 defines an intermediate annular cavity 59 at its upper end. Intermediate annular cavity 59 is in fluid communication with intermediate annulus 58.

According to an embodiment, intermediate casing hanger 55 has an outer annular pressure relief conduit 47 formed therethrough. Similarly, intermediate annular seal bushing 60 has an intermediate bushing pressure relief conduit 67 formed therethrough. The lower end of outer annular pressure relief conduit 47 opens to lower cavity 49 so that it is in fluid communication with outer annulus 48. The upper end of outer annular pressure relief conduit 47 aligns with and is in fluid communication with the lower end of intermediate bushing pressure relief conduit 67. Intermediate bushing pressure relief conduit 67 opens to intermediate annular cavity 59 so that it is in fluid communication with intermediate annulus 58.

According to some embodiments, an outer annular pressure relief valve 44 may be disposed along the fluid communication path of conduits 47 and 67. In one embodiment, outer annular pressure relief valve 44 is disposed along outer annular pressure relief conduit 47, while in another embodiment, outer annular pressure relief valve 44 is located within intermediate bushing pressure relief conduit 67. Outer annular pressure relief valve 44 is designed and arranged to selectively open and/or shut, based on pressure, temperature, and/or time as described in greater detail below, thereby selectively venting outer annulus 48.

An inner annular seal bushing 80 is received within well head housing 40 above inner casing hanger 75. Inner annular seal bushing 80 includes O-rings or other seals that seal inner annular seal bushing 80 between an interior wall of well head housing 40 and an exterior wall of inner casing 70, inner casing hanger 75, or both, thereby sealing intermediate annulus 58 and intermediate annular cavity 59. In some embodiments, radial locking pins 81 may be set through apertures 82 formed in well head housing 40 and recesses 83 formed in inner annular seal bushing 80 to ensure proper rotative alignment and lock inner annular seal bushing 80 into place within well head housing 40.

A production tubing 90 is run into inner casing 70. An upper end of production tubing 90 is connected to a tubing hanger 95, and tubing hanger 95 is seated on a shoulder 96 formed by a top end of inner annular seal bushing 80, thereby suspending production tubing 90 within inner casing 70.

The region between the interior of inner casing 70 and the exterior defines an inner annulus 78. Inner annular seal bushing 80 defines an inner annular cavity 79 at its upper end. Inner annular cavity 79 is in fluid communication with inner annulus 78.

According to an embodiment, inner casing hanger 75 has an intermediate annular pressure relief conduit 57 formed therethrough. Similarly, inner annular seal bushing 80 has an inner bushing pressure relief conduit 87 formed therethrough. The lower end of intermediate annular pressure relief conduit 57 aligns with and is in fluid communication with the upper end of intermediate bushing pressure relief conduit 67. The upper end of intermediate annular pressure relief conduit 57 aligns with and is in fluid communication with the lower end of inner bushing pressure relief conduit 87. However, in another embodiment (not illustrated), the upper end of intermediate annular pressure relief conduit 57 and the lower end of inner bushing pressure relief conduit 87 could both open to intermediate annular cavity 59, thereby establishing fluid communication between the respective conduits. The upper end of inner bushing pressure relief conduit 87 opens to inner annular cavity 79 so that it is in fluid communication with inner annulus 78.

According to some embodiments, an intermediate annular pressure relief valve 54 may be disposed along the fluid communication path of conduits 57 and 87. In one embodiment, intermediate annular pressure relief valve 54 is disposed along intermediate annular pressure relief conduit 57, while in another embodiment, intermediate annular pressure relief valve 54 could also be located within inner bushing pressure relief conduit 87. Intermediate annular pressure relief valve 54 is designed and arranged to selectively open and/or shut, based on pressure, temperature, and/or time as described in greater detail below, thereby selectively venting intermediate annulus 58 and/or outer annulus 48.

According to an embodiment, tubing hanger 95 has a central bore extending between an upper end and a lower end of hanger 95, and tubing hanger 95 further has an inner annular pressure relief conduit 77 formed therein. The lower end of inner annular pressure relief conduit 77 opens to inner annular cavity 79 so that it is in fluid communication with inner annulus 78. The upper end of inner annular pressure relief conduit 77 is in fluid communication with the central bore of hanger 95 and thus, the interior of production tubing 90.

According to some embodiments, inner annular pressure relief conduit 77 includes an inner annular pressure relief valve 74 disposed therein. Inner annular pressure relief valve 74 is designed and arranged to selectively open and/or shut, based on pressure, temperature, and/or time as described in greater detail below, thereby selectively venting inner annulus 78, intermediate annulus 58 and/or outer annulus 48.

Figure 4A:
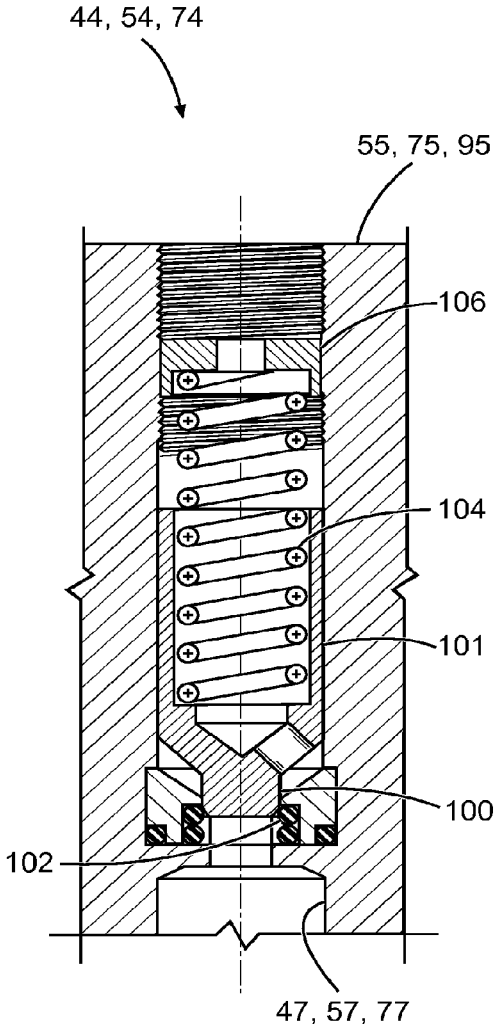
FIG. 4A is an axial cross section of a pressure relief valve assembly for use within the well head of FIG. 2 according to an embodiment, showing a pressure relief valve assembly with an adjustable spring-loaded seat in a shut position.
Figure 4B:
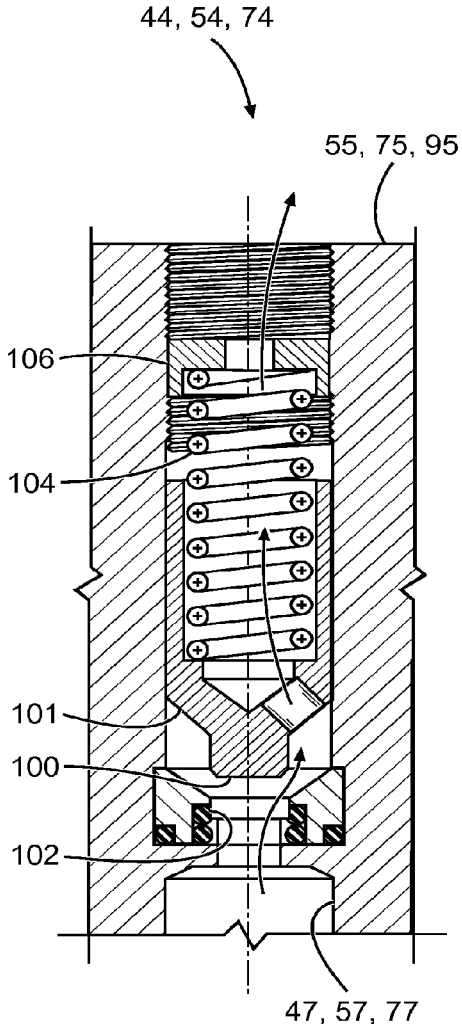
FIG. 4B is an axial cross section of a pressure relief valve assembly of FIG. 4A, showing a relief flow path through the pressure relief valve assembly when in an open position.

Although those foregoing embodiments employing a pressure relieve valve(s) are not limited to a particular type of relive valve, FIGS. 4A and 4B are axial cross sections of an exemplar pressure relief valve, shown in the shut and open positions respectively, which in an embodiment may be used for each of outer annular pressure relief valve 44, intermediate annular pressure relief valve 54, and/or inner annular pressure relief valve 74. Referring to FIGS. 4A and 4B, annular pressure relief valve 44, 54, 74 may be disposed within annular pressure relief conduit 47, 57, 77 formed within hanger 55, 75, 95, respectively.

In an embodiment, annular pressure relief valve 44, 54, 74 may be a poppet valve, which may include a movable poppet 100 that engages and seals against a seat ring 102. Poppet 100 is formed at the distal end of an axially travelling stem 101. Poppet 100 is urged against scat ring 102 by an adjustable spring 104 that is disposed between poppet 100 and a stop screw 106. The axial position of stop screw 106 determines the compressive preload on spring 104 and, as a result, the pressure set point at which poppet 100 will move off of seat ring 102 against the spring force to relieve pressure. When fluid pressure bearing against poppet 100 is less than the lifting set point, poppet 100 is seated and sealed against seat ring 102 by spring 104. When fluid pressure bearing against poppet 100 is greater than the lifting set point, poppet 100 is lifted away from seat ring 102, allowing fluid flow through annular pressure relief valve 44, 54, 74 as indicated by the flow arrows in FIG. 4B.

In an embodiment, annular pressure relief valve 44, 54, 74 is located within hanger 55, 75, 95 so that stop screw 106 may be easily accessed for set point adjustment and valve maintenance and/or repair.

According to another embodiment, annular pressure relief valve 44, 54, 74 may be adapted to selectively open and shut based on fluid pressure, temperature, and or elapsed time, for example. Such valves are commercially available. For instance, an electronic remote equalizing device (eRED®) available from Red Spider Technology, Ltd. is a battery-operated computer controlled ball valve that can be repeatedly opened and closed remotely. An eRED® ball valve includes integrated pressure and temperature sensors and a clock circuit, and it may be preprogrammed to open or shut whenever a specified condition—temperature, pressure, time, or combination thereof,—is detected. This process may be repeated without any form of intervention.

Accordingly, during drilling and completion operations, annular pressure relief valve 44, 54, 74 may be set to open at a predetermined pressure to allow fluid pressure be released in a controlled manner and prevent loss of casing integrity. The flow stream through annular pressure relief valve 44, 54, 74 may provide an indication of when the maximum wellbore surface temperature has been reached. After the wellbore temperature and annulus pressure have stabilized during production operations at the maximum temperature, annular pressure relief valve 44, 54, 74 may be programmed to shut, thereby sealing all casing annuli until a subsequent predetermined pressure activates the valve(s) again. It will be appreciated that not all relief valves need be activated at the same predetermined pressure. The predetermined pressure may be selected, in some embodiments, based on the sizing or other characteristics of the casing or tubing forming the annulus serviced by the pressure relief valve.

Figure 5A:
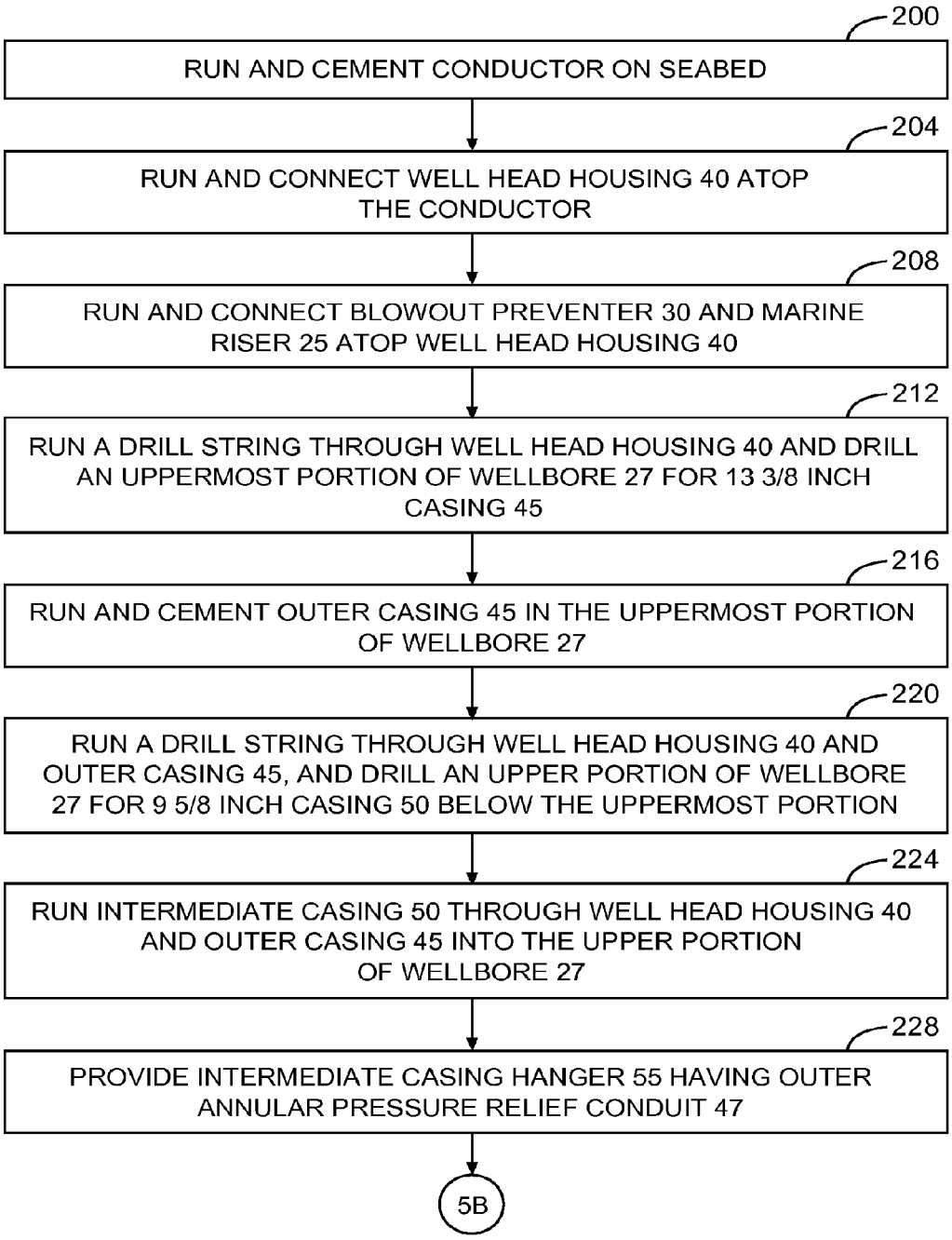
FIGS. 5A-5C are a flow chart of a method for producing hydrocarbons according to an embodiment that uses the well and drilling system of FIGS. 1-4.
Figure 5B:
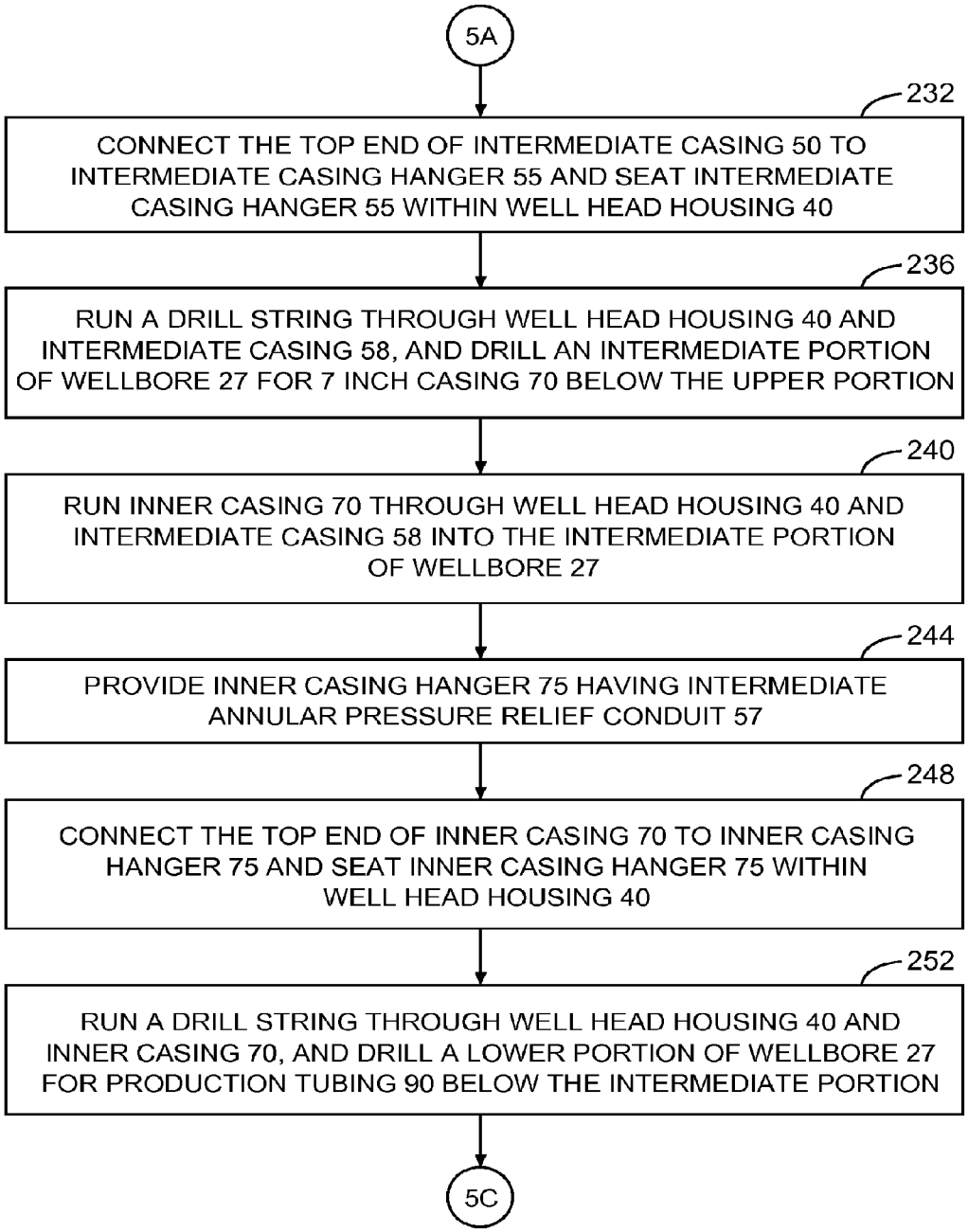
Figure 5C:
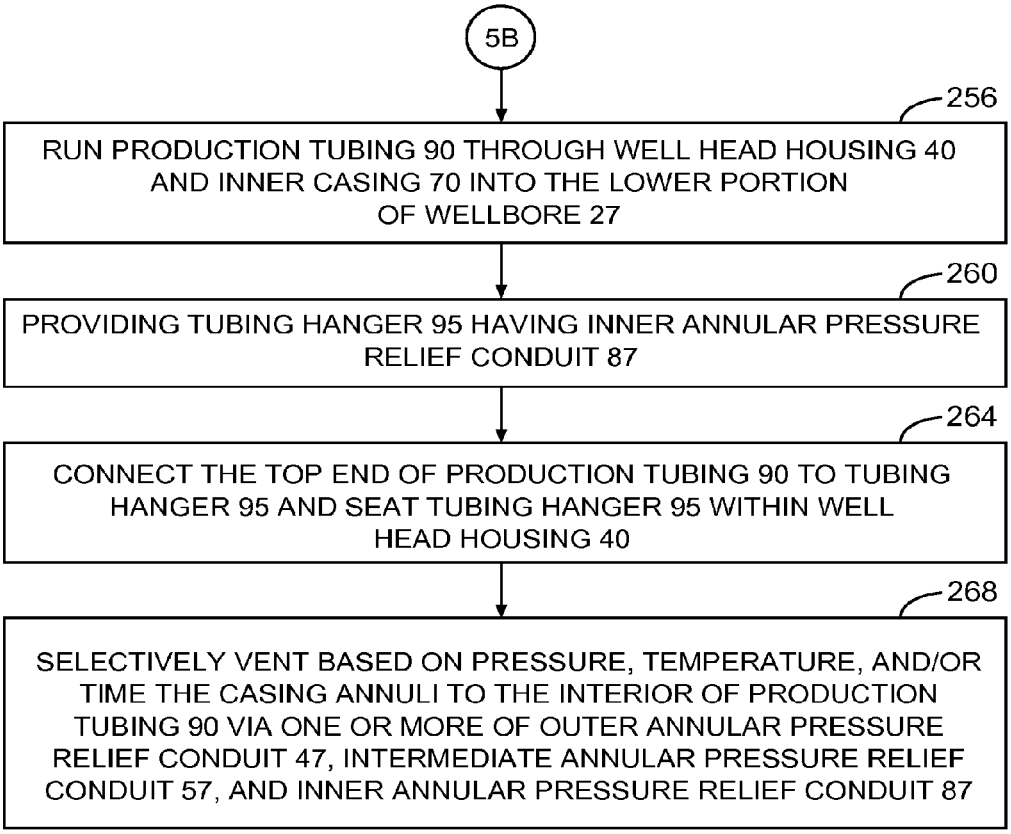

FIGS. 5A-5C are a flowchart for a method of producing hydrocarbons according to an embodiment, using the well and offshore drilling system of FIG. 1-4. The method is equally adaptable for on-shore wells. Referring primarily to FIGS. 5A-5C, with reference to FIGS. 1-4, at 200, a surface casing (not illustrated) is run, typically by drilling, jetting, or driving, and then cemented at the selected well location on the seabed. At step 204, well head housing 40 is run and connected atop the surface casing. At step 208, marine riser 25 and blowout preventer 30 are connected to the top of well head housing 40. Marine riser 25 extends upward to offshore platform 20.

Wellbore 27 is drilled and cased in segments, with each subsequent segment having a smaller diameter. In steps 212 and 216, the uppermost portion of wellbore 27 is drilled and cased with outer casing 45, respectively. In an embodiment, outer casing 45 is 13⅜ inch casing, although other sizes may be used as appropriate. Outer casing 45 may be cemented within the uppermost portion of wellbore 27. The top end of outer casing 45 terminates within well head housing 40.

Next, in step 220, an upper portion of wellbore 27 is drilled through well head housing 40 and outer casing 45. In step 224, intermediate casing 50 is run through well head housing 40 and outer casing 45 into the upper portion of wellbore 27. In steps 228 and 232, intermediate casing 50 is connected to and suspended within well head housing 40 by intermediate casing hanger 55. Intermediate casing hanger 55 includes outer annular pressure relief conduit 47, which is arranged to selectively vent outer annulus 48, defined by the region between outer casing 45 and intermediate casing 55. In an embodiment, intermediate casing 50 is a 9⅝ inch casing.

Likewise, in step 236, an intermediate portion of wellbore 27 is drilled through well head housing 40 and intermediate casing 50. In step 240, inner casing 70 is run through well head housing 40 and intermediate casing 50 into the intermediate portion of wellbore 27. In steps 244 and 248, inner casing 70 is connected to and suspended within well head housing 40 by inner casing hanger 75. Inner casing hanger 75 includes intermediate annular pressure relief conduit 57, which is arranged to selectively vent both intermediate annulus 58, defined by the region between intermediate casing 50 and inner casing 70, and outer annulus 48. In an embodiment, inner casing 70 is a 7 inch casing.

Production tubing 90 is installed in a substantially similar manner. In step 252, a lower portion of wellbore 27 is drilled through well head housing 40 and inner casing 70. In step 256, production tubing 90 is run through well head housing 40 and inner casing 70 into the lower portion of wellbore 27. In steps 260 and 264, production tubing 90 is connected to and suspended within well head housing 40 by tubing hanger 95. Tubing hanger 95 includes inner annular pressure relief conduit 87, which is arranged to selectively vent inner annulus 78, defined by the region between inner casing 70 and production tubing 90, intermediate annulus 58, and outer annulus 48.

Finally, in step 268, one or more of the casing annuli—inner annulus 78, intermediate annulus 58, and outer annulus 48—are selectively vented to the interior of production tubing 90 via inner annular pressure relief conduit 87, intermediate annular pressure relief conduit 57, and/or outer annular pressure relief conduit 47. The casing annuli maybe selectively vented based on pressure, temperature, time, or a combination thereof.

Although well head 24 is illustrated and described as having an outer, intermediate and inner casing, it may include few or more casings defining various casing annuli, which may be vented in a similar manner as described herein. Moreover, more than one coaxial production tubing may be included, defining one or more annuli therebetween. Accordingly, a routineer in the art will recognize that the present disclosure and claims cover embodiments with coaxial arrangements of piping strings and resultant annuli, regardless of whether a particular piping string is considered to be production tubing or casing.

The system and method disclosed herein provide a mechanically straightforward and reliable way to vent trapped pressurized fluid under controlled conditions at the well head without operator intervention. The pressure relief mechanism is entirely independent, opening and shutting based on flexible predetermined parameters. Accordingly, without the need to compensate for annulus pressure buildup, casing specifications may be relaxed.

In summary, a hanger system, a well and a method of producing hydrocarbons have been described. Embodiments of the hanger system may generally have: A first piping hanger having an upper end and a lower end with a first pressure relief conduit formed within the first piping hanger and extending between the upper and lower ends of the first piping hanger; a first piping string carried by the first piping hanger; a second piping hanger having an upper end and a lower end with a second pressure relief conduit formed within the second piping hanger and extending between the upper and lower ends of the second piping hanger; and a second piping string carried by the second piping hanger; wherein the first piping hanger and the second piping hanger are positioned in proximity to one another so that the first pressure relief conduit is in fluid communication with the second pressure relief conduit. Embodiments of the well may generally have: A wellbore formed in the earth; a well head housing disposed atop of the wellbore; an outer casing disposed in the wellbore, a top end of the outer casing connected to and in fluid communication with the well head housing; an intermediate casing disposed within the outer casing, a region between the outer casing and the intermediate casing defining an outer annulus; an intermediate casing hanger connected to a top end of the intermediate casing and seated with the well head housing above the top end of the outer casing, the intermediate casing hanger suspending the intermediate casing; a production tubing disposed in the intermediate casing; a tubing hanger connected to a top end of the production tubing and seated within the well head housing above the intermediate casing hanger, the tubing hanger suspending the production tubing; an outer annular pressure relief conduit formed within the intermediate casing hanger, the outer annular pressure relief conduit forming at least part of a pressure relief flow path from the outer annulus to an interior region of the production tubing; and an outer annular pressure relief valve disposed within the pressure relief flow path. Embodiments of the method of producing hydrocarbons may generally include: Installing a first piping string in a wellbore by suspending the first piping string from a first piping string hanger; installing a second piping string in the wellbore by suspending the second piping string from a second piping string hanger so as to form an annulus between a portion of the first piping string and the second piping string; and selectively venting a pressure through a first pressure relief conduit formed through the first piping string hanger and through a second pressure relief conduit formed through the second piping string hanger.

Any of the foregoing embodiments may include any one of the following elements or characteristics, alone or in combination with each other: A pressure relief valve disposed along the first pressure relief conduit or the second pressure relief conduit; a third piping hanger having an upper end and a lower end with a third pressure relief conduit formed within the third piping hanger and extending between the upper and lower ends of the third piping hanger; a third piping string carried by the third tubing hanger; the second piping hanger and the third piping hanger are positioned in proximity to one another so that the second pressure relief conduit is in fluid communication with the third pressure relief conduit; a first pressure relief valve disposed along the first pressure relief conduit or the second pressure relief conduit; a second pressure relief valve disposed along the third pressure relief conduit; the first piping string is an outer casing; the second piping string is an intermediate casing disposed within the outer casing; a production tubing hanger having an upper end and a lower end with a central bore extending therebetween and a pressure relief conduit formed within the production tubing hanger extending from the lower end of the production tubing hanger to the central bore; a production tubing string carried by the production tubing hanger; a seal bushing disposed between the first and second piping hangers; the seal bushing having an upper end and a lower end with a third pressure relief conduit formed within the seal bushing and extending between the upper and lower ends of the seal bushing so that the third pressure relief conduit is in fluid communication with the first and second pressure relief conduits; the seal bushing defines a cavity; the third pressure relief conduit is in fluid communication with the cavity; at least the first or the second pressure relief conduit is in fluid communication with the cavity, the outer annular pressure relief valve is disposed within the outer annular pressure relief conduit; an inner annular pressure relief conduit formed within the tubing hanger, the inner annular pressure relief conduit forming at least part of the pressure relief flow path; an inner annular pressure relief valve disposed within the pressure relief flow path downstream of the outer annular pressure relief valve; the inner annular pressure relief valve is disposed within the inner annular pressure relief conduit; an inner casing disposed between the intermediate casing and the production tubing, a region between the intermediate casing and the inner casing defining an intermediate annulus, a region between the inner casing and the production tubing defining an inner annulus; an inner casing hanger connected to a top end of the inner casing and seated within the well head housing above the intermediate casing hanger and below the tubing hanger; an intermediate annular pressure relief conduit formed within the inner casing hanger and forming at least part of the pressure relief flow path; an intermediate annular pressure relief valve disposed within the pressure relief flow path downstream of the outer annular pressure relief valve and upstream of the inner annular pressure relief valve; the intermediate annular pressure relief valve is disposed within the intermediate annular pressure relief conduit; the inner annular pressure relief conduit is fluidly coupled to the inner annulus upstream of the inner annular pressure relief valve; the intermediate annular pressure relief conduit is fluidly coupled to the intermediate annulus upstream of the intermediate annular pressure relief valve; an intermediate annular seal bushing disposed within the well head housing between the intermediate casing hanger and the inner casing hanger, the intermediate annular seal bushing including an intermediate annular cavity that is fluidly coupled to the intermediate annulus; an intermediate bushing pressure relief conduit formed within the intermediate annular seal bushing, fluidly coupled to between the outer annular pressure relief conduit and the intermediate annular pressure relief conduit, and forming at least a portion of the pressure relief flow path; an inner annular seal bushing disposed within the well head housing between the inner casing hanger and the tubing hanger, the inner annular seal bushing including an inner annular cavity that is fluidly coupled to the inner annulus; an inner bushing pressure relief conduit formed within the inner annular seal bushing, fluidly coupled to between the intermediate annular pressure relief conduit and the inner annular pressure relief conduit, and forming at least a portion of the pressure relief flow path; an intermediate annular seal bushing disposed within the well head housing between the intermediate casing hanger and the tubing hanger; an intermediate bushing pressure relief conduit formed within the intermediate annular seal bushing, fluidly coupled to between the outer annular pressure relief conduit and the inner annular pressure relief conduit, and forming at least a portion of the pressure relief flow path; the well head housing is disposed at a location on a seabed; the well further comprises a marine riser coupled between an offshore platform and an upper end of the well head housing; at least one from the group consisting of the outer annular pressure relief valve and the inner annular pressure relief valve is designed and arranged to open at a predetermined pressure; at least one from the group consisting of the outer annular pressure relief valve and the inner annular pressure relief valve is designed and arranged to shut based on at least one from the group consisting of an elapsed time and a temperature; installing an outer casing in the wellbore; the first piping string is an intermediate casing at least partially disposed within the outer casing; the second piping string is an inner casing at least partially disposed within the intermediate casing; installing a well head housing at a location on the surface of the earth; running a first drill string through the well head housing; drilling using the first drill string an uppermost portion of a wellbore; installing an outer casing in the uppermost portion of the wellbore; running a second drill string through the well head housing and the outer casing; drilling using the second drill string an upper portion of the wellbore below the uppermost portion; running an intermediate casing through the well head housing and outer casing into the upper portion of the wellbore; providing an intermediate casing hanger having an outer annular pressure relief conduit formed therethrough; connecting a top end of the intermediate casing to the intermediate casing hanger; suspending the intermediate casing by seating the intermediate casing hanger within the well head housing, a region between the outer casing and the intermediate casing defining an outer annulus; running a third drill string through the well head housing and intermediate casing; drilling using the third drill string a lower portion of the wellbore below the upper portion; running a production tubing through the well head housing into the lower portion of the wellbore; providing a tubing hanger having an inner annular pressure relief conduit formed therein; connecting a top end of the production tubing to the tubing hanger; suspending the production tubing by seating the tubing hanger within the well head housing; and selectively venting the outer annulus to an interior of the production tubing via the outer annular pressure relief conduit and the inner annular pressure relief conduit; running a fourth drill string through the well head housing and intermediate casing; drilling using the fourth drill string an intermediate portion of the wellbore below the upper portion and above the lower portion of the wellbore; running an inner casing through the well head housing and the intermediate casing into the intermediate portion of the wellbore; providing an inner casing hanger having an intermediate annular pressure relief conduit formed therethrough; connecting a top end of the inner casing to the inner casing hanger; suspending the inner casing by seating the inner casing hanger within the well head housing, a region between the intermediate casing and the inner casing defining an intermediate annulus; selectively venting the intermediate annulus to the interior of the production tubing via the intermediate annular pressure relief conduit and the inner annular pressure relief conduit; selectively venting the outer annulus to the interior of the production tubing via the intermediate annular pressure relief conduit; the production tubing is disposed within the inner casing; a region between the inner casing and the production tubing defines an inner annulus; selectively venting at least one of the group consisting of the outer annulus, the intermediate annulus and the inner annulus to the interior of the production tubing based on a pressure; preventing venting of at least one of the group consisting of the outer annulus, the intermediate annulus and the inner annulus based on at least one from the group consisting of an elapsed time and a temperature; the well head housing is located at a subsea location; and the method further comprises coupling a marine riser between an offshore platform and an upper end of the well head housing.

The Abstract of the disclosure is solely for providing the patent office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A hanger system for an oil and gas well, the hanger system, comprising:

a first piping hanger having an upper end and a lower end with a first pressure relief conduit formed within the first piping hanger and extending between the upper and lower ends of the first piping hanger;

a first piping string carried by the first piping hanger;

a second piping hanger having an upper end and a lower end with a second pressure relief conduit formed within the second piping hanger and extending between the upper and lower ends of the second piping hanger;

a second piping string carried by the second piping hanger;

a third piping hanger having an upper end and a lower end with a third pressure relief conduit formed within the third piping hanger;

a third piping string carried by the third tubing hanger; and a seal bushing disposed between the first piping hanger and the second piping hanger, the seal bushing including a fourth pressure relief conduit formed within the seal bushing that is in fluid communication with the first and second pressure relief conduits;

wherein the first piping hanger and the second piping hanger are positioned in proximity to one another so that the first pressure relief conduit is in fluid communication with the second pressure relief conduit;

wherein the second piping hanger and the third piping hanger are positioned in proximity to one another so that the second pressure relief conduit is in fluid communication with the third pressure relief conduit.

2. The hanger system of claim 1, further comprising:

a pressure relief valve disposed along the first pressure relief conduit or the second pressure relief conduit.

3. The hanger system of claim 1, further comprising:

a first pressure relief valve disposed along the first pressure relief conduit or the second pressure relief conduit; and a second pressure relief valve disposed along the third pressure relief conduit.

4. The hanger system of claim 1, wherein:

the first piping string is an outer casing;

the second piping string is an intermediate casing disposed within said outer casing;

the third piping string is a production tubing string; and the third piping hanger is a production tubing hanger, the production tubing hanger having a central bore extending between the third piping hanger upper and lower ends with the third pressure relief conduit extending from the lower end of the production tubing hanger to the central bore.

5. The hanger system of claim 1, wherein the fourth pressure relief conduit extends between an upper end and a lower end of the seal bushing.

6. The hanger system of claim 5, wherein:

the seal bushing defines a cavity, the fourth pressure relief conduit is in fluid communication with the cavity; and at least the first or the second pressure relief conduit is in fluid communication with the cavity.

7. A well comprising:

a wellbore formed in the earth;

a well head housing disposed atop of said wellbore;

an outer casing disposed in said wellbore, a top end of said outer casing connected to and in fluid communication with said well head housing;

an intermediate casing disposed within said outer casing, a region between said outer casing and said intermediate casing defining an outer annulus;

an intermediate casing hanger connected to a top end of said intermediate casing and seated with said well head housing above said top end of said outer casing, said intermediate casing hanger suspending said intermediate casing;

a production tubing disposed in said intermediate casing;

a tubing hanger connected to a top end of said production tubing and seated within said well head housing above said intermediate casing hanger, said tubing hanger suspending said production tubing;

an outer annular pressure relief conduit formed within said intermediate casing hanger, said outer annular pressure relief conduit forming at least part of a pressure relief flow path from said outer annulus to an interior region of said production tubing;

an outer annular pressure relief valve disposed within said pressure relief flow path;

an inner casing disposed between said intermediate casing and said production tubing;

an inner casing hanger connected to a top end of said inner casing and seated within said well head housing above said intermediate casing hanger and below said tubing hanger;

an intermediate annular pressure relief conduit formed within said inner casing hanger and forming at least part of said pressure relief flow path; and an intermediate annular seal bushing disposed between an interior wall of said well head housing and an exterior wall of at least one of said intermediate casing and said intermediate casing hanger, said intermediate annular seal bushing including an intermediate bushing pressure relief conduit that forms at least a portion of said pressure relief flow path.

8. The well of claim 7 wherein:

said outer annular pressure relief valve is disposed within said outer annular pressure relief conduit.

9. The well of claim 7 further comprising:

an inner annular pressure relief conduit formed within said tubing hanger, said inner annular pressure relief conduit forming at least part of said pressure relief flow path; and an inner annular pressure relief valve disposed within said pressure relief flow path downstream of said outer annular pressure relief valve.

10. The well of claim 9 wherein:

said inner annular pressure relief valve is disposed within said inner annular pressure relief conduit.

11. The well of claim 9 further comprising:

a region between said intermediate casing and said inner casing defining an intermediate annulus;

a region between said inner casing and said production tubing defining an inner annulus; and an intermediate annular pressure relief valve disposed within said pressure relief flow path downstream of said outer annular pressure relief valve and upstream of said inner annular pressure relief valve.

12. The well of claim 11 wherein:

said intermediate annular pressure relief valve is disposed within said intermediate annular pressure relief conduit.

13. The well of claim 11 wherein:

said inner annular pressure relief conduit is fluidly coupled to said inner annulus upstream of said inner annular pressure relief valve.

14. The well of claim 11 wherein:

said intermediate annular pressure relief conduit is fluidly coupled to said intermediate annulus upstream of said intermediate annular pressure relief valve.

15. The well of claim 11 further comprising:

an inner annular seal bushing disposed within said well head housing between said inner casing hanger and said tubing hanger, said inner annular seal bushing including an inner annular cavity that is fluidly coupled to said inner annulus; and an inner bushing pressure relief conduit formed within said inner annular seal bushing, fluidly coupled to between said intermediate annular pressure relief conduit and said inner annular pressure relief conduit, and forming at least a portion of said pressure relief flow path;

wherein the intermediate annular seal bushing is disposed within said well head housing between said intermediate casing hanger and said inner casing hanger, said intermediate annular seal bushing including an intermediate annular cavity that is fluidly coupled to said intermediate annulus;

wherein the intermediate bushing pressure relief conduit is formed within said intermediate annular seal bushing, and is fluidly coupled between said outer annular pressure relief conduit and said intermediate annular pressure relief conduit.

16. The well of claim 9 wherein:

the intermediate annular seal bushing is disposed within said well head housing between said intermediate casing hanger and said tubing hanger;

the intermediate bushing pressure relief conduit formed within said intermediate annular seal bushing, is fluidly coupled to between said outer annular pressure relief conduit and said inner annular pressure relief conduit, and forming at least a portion of said pressure relief flow path.

17. The well of claim 7 wherein:

said well head housing is disposed at a location on a seabed; and the well further comprises a marine riser coupled between an offshore platform and an upper end of said well head housing.

18. The well of claim 9 wherein:

at least one from the group consisting of said outer annular pressure relief valve and said inner annular pressure relief valve is designed and arranged to open at a predetermined pressure.

19. The well of claim 9 wherein:

at least one from the group consisting of said outer annular pressure relief valve and said inner annular pressure relief valve is designed and arranged to shut based on at least one from the group consisting of an elapsed time and a temperature.

20. A method of producing hydrocarbons, comprising:

installing a first piping string in a wellbore by suspending said first piping string from a first piping string hanger having a first pressure relief conduit formed through said first piping string hanger;

installing a second piping string in the wellbore by suspending said second piping string from a second piping string hanger so as to form an annulus between a portion of the first piping string and the second piping string, said second piping string hanger having a second pressure relief conduit formed through said second piping string hanger;

seating said second piping string hanger on a shoulder formed by a top end of a seal bushing having a bushing pressure relief conduit formed through said seal bushing;

running a third piping string into said wellbore;

connecting a top end of said third piping string to a third piping string hanger so as to form an annulus between a portion of the second piping string and the third piping string, said third piping string having a third pressure relief conduit formed through said third piping string hanger; and selectively venting a pressure through said first pressure relief conduit and through said second pressure relief conduit, where said first pressure relief conduit is in fluid communication with said bushing pressure relief conduit and said second pressure relief conduit is in fluid communication with said third pressure relief conduit.

21. The method of claim 20 further comprising:

installing an outer casing in said wellbore; wherein said first piping string is an intermediate casing at least partially disposed within said outer casing;

said second piping string is an inner casing at least partially disposed within said intermediate casing;

said third piping string is a production tubing at least partially disposed within said inner casing;

said first piping string hanger is an intermediate casing hanger and said first pressure relief conduit is an outer annular pressure relief conduit formed therethrough;

said second piping string hanger is an inner casing hanger and said second pressure relief conduit is an intermediate annular pressure relief conduit formed therethrough; and said third piping string hanger is a tubing hanger and said third pressure relief conduit is an inner annular pressure relief conduit formed therein.

22. The method of claim 21 further comprising:

installing a well head housing at a location on the surface of the earth;

running a first drill string through said well head housing;

drilling using said first drill string an uppermost portion of the wellbore;

installing said outer casing in said uppermost portion of said wellbore;

running a second drill string through said well head housing and said outer casing;

drilling using said second drill string an upper portion of said wellbore below said uppermost portion;

running the intermediate casing through said well head housing and said outer casing into said upper portion of said wellbore;

connecting a top end of said intermediate casing to said intermediate casing hanger;

suspending said intermediate casing by seating said intermediate casing hanger within said well head housing, a region between said outer casing and said intermediate casing defining an outer annulus;

running a third drill string through said well head housing and said intermediate casing;

drilling using said third drill string a lower portion of said wellbore below said upper portion;

running said production tubing through said well head housing and into said lower portion of said wellbore;

suspending said production tubing by seating said tubing hanger within said well head housing; and selectively venting said outer annulus to an interior of said production tubing via said outer annular pressure relief conduit and said inner annular pressure relief conduit.

23. The method of claim 22 further comprising:

running an additional drill string through said well head housing and said intermediate casing;

drilling using said additional drill string an intermediate portion of said wellbore below said upper portion and above said lower portion of said wellbore;

running the inner casing through said well head housing and intermediate casing into said intermediate portion of said wellbore;

connecting a top end of said inner casing to said inner casing hanger;

suspending said inner casing by seating said inner casing hanger within said well head housing, a region between said intermediate casing and said inner casing defining an intermediate annulus; and selectively venting said intermediate annulus to said interior of said production tubing via said intermediate annular pressure relief conduit and said inner annular pressure relief conduit.

24. The method of claim 23 further comprising:

selectively venting said outer annulus to said interior of said production tubing via said intermediate annular pressure relief conduit.

25. The method of claim 23 wherein:

a region between said inner casing and said production tubing defines an inner annulus; and the method further comprises selectively venting said inner annulus to said interior of said production tubing via said inner annular pressure relief conduit.

26. The method of claim 25 further comprising:

selectively venting at least one of the group consisting of said outer annulus, said intermediate annulus and said inner annulus to said interior of said production tubing based on a pressure.

27. The method of claim 25 further comprising:

preventing venting of at least one of the group consisting of said outer annulus, said intermediate annulus and said inner annulus based on at least one from the group consisting of an elapsed time and a temperature.

28. The method of claim 22 wherein:

said well head housing is located at a subsea location; and the method further comprises coupling a marine riser between an offshore platform and an upper end of said well head housing.

* * * * *